United States Patent [19]

Pfaffle

[11] Patent Number: 4,874,279

[45] Date of Patent: Oct. 17, 1989

[54] SEMI-AUTOMATIC BINDER

[75] Inventor: Ernst Pfaffle, Neuffen, Fed. Rep. of Germany

[73] Assignee: Sickinger Company, Auburn Hills, Mich.

[21] Appl. No.: 182,108

[22] Filed: Apr. 15, 1988

[51] Int. Cl.[4] ..... B42B 5/10

[52] U.S. Cl. ..... 412/39

[58] Field of Search ..... 412/38, 39, 40

[56] References Cited

U.S. PATENT DOCUMENTS

| | | | |
|---|---|---|---|
| 3,555,587 | 1/1971 | Seaborn | 412/39 X |
| 3,667,076 | 6/1972 | Agloghanian et al. | 412/39 |
| 3,854,158 | 12/1974 | Pigna et al. | 412/39 |
| 4,487,538 | 11/1984 | Jones et al. | 412/39 |
| 4,610,590 | 9/1986 | Pigna | 412/39 X |

FOREIGN PATENT DOCUMENTS

| | | | |
|---|---|---|---|
| 1074953 | 11/1954 | France | 412/39 |

*Primary Examiner*—Paul A. Bell

*Attorney, Agent, or Firm*—Harness, Dickey & Pierce

[57] ABSTRACT

A semi-automatic binder is disclosed which incorporates a conveyor for transporting a preformed length of double wire binder to a loading station. The loading station incorporates a unique support arrangement whereby the free ends of the double wire binder are presented for quick and easy manual assembly thereto of sheets to be bound. The thus assembled sheets and binder are then moved to a closing station employing an adjustable pressure bar operative to close the double wire binder. Both the support arrangement and pressure bar are readily adjustable to enable the binder of the present invention to accommodate a wide variety of sizes of double wire binders.

13 Claims, 3 Drawing Sheets

SEMI-AUTOMATIC BINDER

BACKGROUND AND SUMMARY OF THE INVENTION

The present invention relates generally to binding machines and more particularly to semi-automatic binding machines for use in loosely securing a plurality of sheets together by means of a preformed wire member.

There exist many applications wherein it is desirable to secure a plurality of sheets together to form a booklet. A wide variety of fastening arrangements are available to accomplish this task, however, the present invention is specifically concerned with the use of a continuous elongated preformed wire member which comprises a plurality of relatively closely spaced side by side generally parallel double wire loops or circles which are interconnected at one end. The wire member is initially formed with the loops in an open condition so as to enable the individual double wire loops to be passed through openings along the marginal edge of the sheets to be bound together. Once the desired sheets are assembled to the preformed wire member, the loops are closed by forming the free ends thereof toward the interconnected ends to thereby form a generally circularly shaped binding for the sheets.

The present invention provides a semi-automatic machine for accomplishing this binding operation in an efficient and relatively easy manner. The apparatus of the present invention incorporates means for severing appropriate predetermined lengths of the preformed wire from a coiled spool and supplying the predetermined lengths to a loading station at which the sheets to be bound may be assembled thereto. The loading station includes a unique support arrangement which is designed to support the double wire binder in such a manner as to enable assembly of the sheets thereto to be accomplished quickly and easily even in the event the loop ends are slightly out of position. The apparatus also incorporates a closing station adjacent the loading station which is designed to automatically feed the double wire binder and associated assembled sheets into position and to thereafter close the loops thus completing the binding operation.

The loading station support arrangement is designed to enable the apparatus to utilize a wide range of different diameter double wire binders requiring only that a single plate member be changed to accommodate the varying diameter loops. The closing station likewise is able to be readily adjusted to accommodate the various diameter double wire binders. Additionally, because the double wire binder is directly supported and retained in position within the closing station, this apparatus is extremely well suited for binding of sheets of differing sizes such as for example booklets incorporating oversize cover sheets or the like.

The binding apparatus of the present invention is extremely well suited for use in moderate volume applications which may not justify the costs associated with fully automatic machines. Further, because the double wire binder is presented and held by the apparatus for the operator to assemble the sheets to, variations in sheet sizes and/or loop spacing can be easily accommodated. Additionally, the design is well suited for ease of manufacture and operation thus assuring reliable, trouble-free economical operation.

Additional advantages and features of the present invention will become apparent from the subsequent description and the appended claims taken in conjunction with the accompanying drawings.

DESCRIPTION OF THE PREFERRED EMBODIMENT

Figure 1:
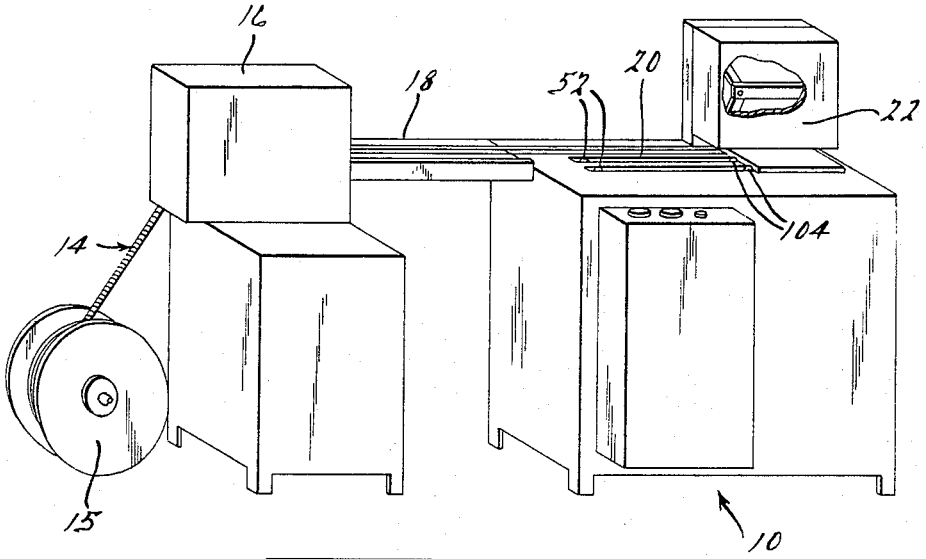
FIG. 1 is a perspective view of the semi-automatic binder of the present invention.
Figure 2:
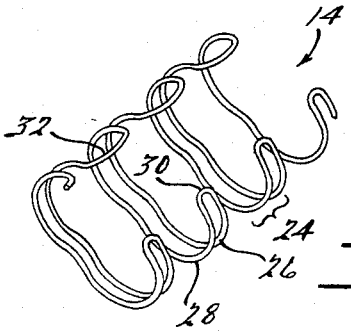
FIG. 2 is a perspective view of a segment of a double wire binder which is utilized in the binder of the present invention, the binder being shown in its open position.
Figure 3:
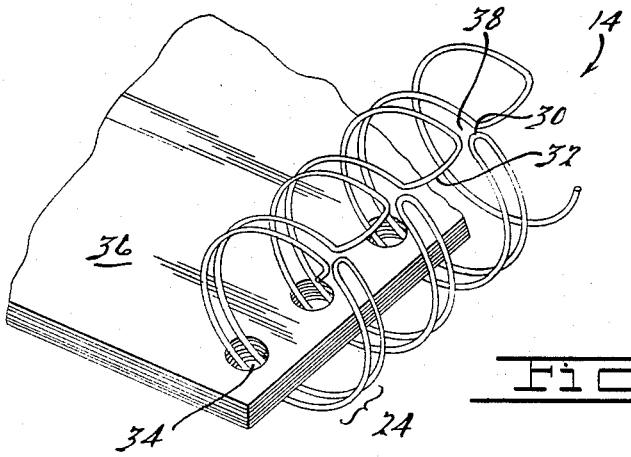
FIG. 3 is a view similar to FIG. 2 but showing the double wire binder in a closed position.

Referring now to the drawings and more particularly to FIGS. 1–3, there is shown a semi-automatic binder in accordance with the present invention indicated generally at 10. Binder 10 is designed to utilize continuous elongated preformed wire binders 14 generally referred to as double wire binders such as is shown in FIG. 2 in order to loosely secure a plurality of sheets together. Double wire binder 14 will generally be supplied to binder 10 from a continuous coil 15 supported at one end thereof adjacent a cutting station 16 which will operate to sever predetermined lengths thereof. A loading station 18 is also provided to which the severed length of double wire binder 14 is transported and at which the operator will manually assemble the desired sheets thereon. The thus assembled sheets and double wire binder are then moved to the right as seen in FIG. 1 to an idle station 20 at which automatic feed means will operate to advance the assembly into the closing station 22.

With reference to FIGS. 2 and 3, double wire binder 14 is formed from a continuous length of suitable size wire and as thus initially formed comprises a series of partial loops 24 generally in the shape of the number 3 arranged in substantially parallel spaced side by side relationship. Each of the loops 24 comprises two substantially parallel relatively closely spaced runs of wire 26, 28 having a relatively tight radius turn defining a free end 30 and longitudinally extending interconnecting portions 32 at the other end which serve to interconnect a plurality of the loops 24. Typically, this binder is produced from a continuous length of wire and coiled on suitable spools from which it may later be supplied to cutting means for severing into predetermined lengths.

Once severed into desired lengths, the free ends 30 of loops 24 are passed through suitably formed openings 34 generally extending along a marginal edge of sheets 36 to be bound after which the free ends 30 are "closed" by moving them toward the gap 38 existing between respective interconnecting portions 32 of the binder 14 whereby the respective loops will have a generally circular cross sectional shape. Double wire binder of this type has been in general use for such applications for a substantial period of time and offers many advantages over other types of binding arrangements, a principle one being that the sheets are maintained in the desired aligned relationship when in either open or closed positions as opposed to being longitudinally shifted as occurs with conventional spiral binding. In any event, it is this double wire binder as described which the apparatus of the present invention is designed to utilize.

Referring once again to FIG. 1, cutting station 16 includes suitable power driven means for advancing wire binder 14 from the supply spool 15 through suitable measuring means whereupon cutting means will operate to sever the desired length thereof. The required length to be severed may be easily adjusted for any desired application and will generally be approximately equal to or slightly shorter than the length of the sheets to be bound.

Figure 4:
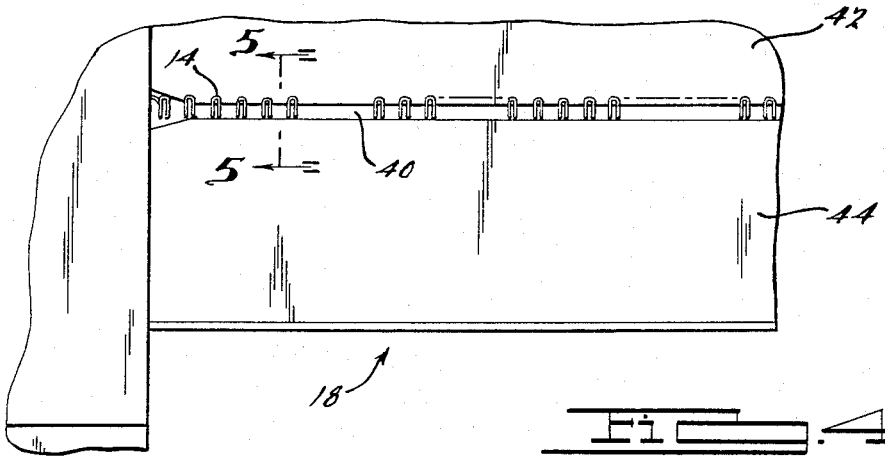
FIG. 4 is a plan view of the loading station forming a part of the binder of FIG. 1 with an open wire binder shown in position for assembly of sheets thereto.
Figure 5:
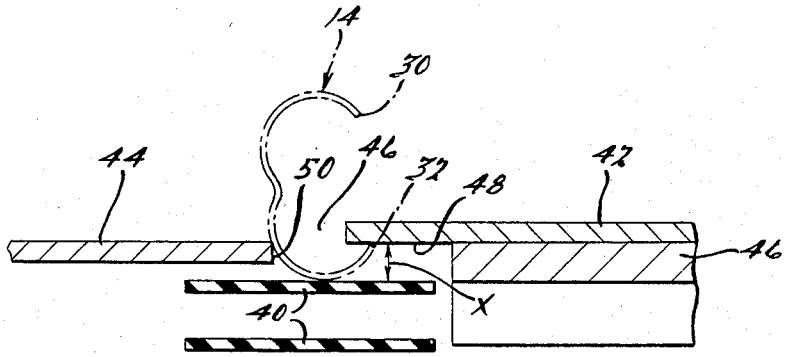
FIG. 5 is a section view of the loading station, the section being taken along line 5—5 of FIG. 4.
Figure 6:
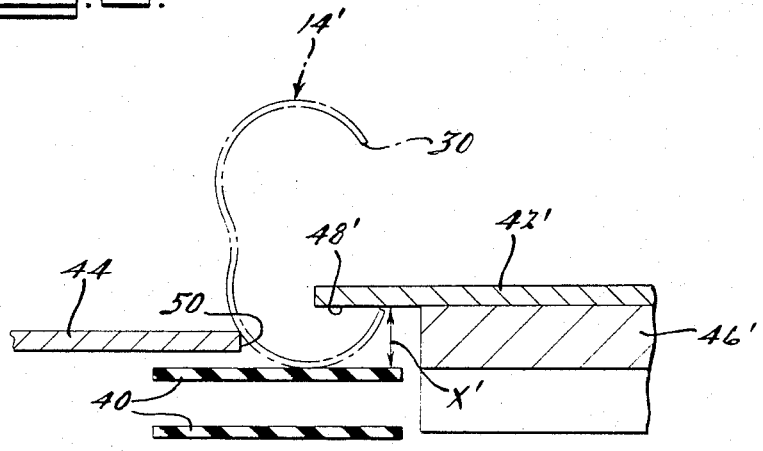
FIG. 6 is a view similar to FIG. 3 but showing the loading station adapted for a larger diameter double wire binder.

The loading station 18 incorporates an endless belt type conveyor means 40 which extends from the cutting station 16 and will operate to transport the severed lengths of wire binder 14 therefrom into loading station 18 at which the sheets to be bound may be assembled thereto. As best seen with reference to FIGS. 4–6, loading station 18 incorporates a pair of elongated plate members 42, 44 supported in generally parallel spaced relationship with respect to each other and in overlying spaced relationship to conveyor belt 40 so as to define an open channel 46 therebetween. Preferably, the width of channel 46 will be less than the diameter of the double wire binder 14 being utilized but will be sufficient to allow free and easy movement of the binder therealong whereby conveyor means 40 may easily transport binder 14 from the cutting station 16 into the loading station. Additionally, as best seen with reference to FIGS. 5 and 6, plate member 42 will be positioned a predetermined distance "X" above conveyor belt 40 by means of a spacer member 46 so as to thereby support double wire binder 14 in a generally upright or slightly tilted position such as shown in FIG. 5 with the interconnected end portions 32 of the loops 24 being supported by the undersurface 48 of plate member 42 and the outer lower surface of the loop portions 24 bearing against the edge 50 of plate member 44. As thus supported, the free ends 30 of the loops 24 are positioned above the upper surfaces of plate members 42, 44 and readily accessible for assembly thereto of the sheets to be bound together. It should be noted that because the wire binder is presented for assembly of the sheets thereto rather than the sheets being presented, it is far easier to assemble sheets of differing sizes.

In order to accommodate larger diameter double loop binders, it is only necessary that a thicker spacer member 46' be utilized between plate member 42' and the associated support structure so as to increase the distance X' between surface 48' and conveyor 40. Accordingly, either separate suitably sized spacers 46 may be supplied for positioning between plate member 42 and the supporting structure or preferably they will be bonded to the plate member 42 to facilitate such readjustment for different size binders.

Once the sheets have been assembled to the double wire binder 14, the assembly is moved to idle station 20 in preparation for advancement into the closing station. At this location, a pair of spaced reciprocating pusher members 52 will operate to advance the assembled sheets and assembled binder 14 into the closing station 22.

Figure 7:
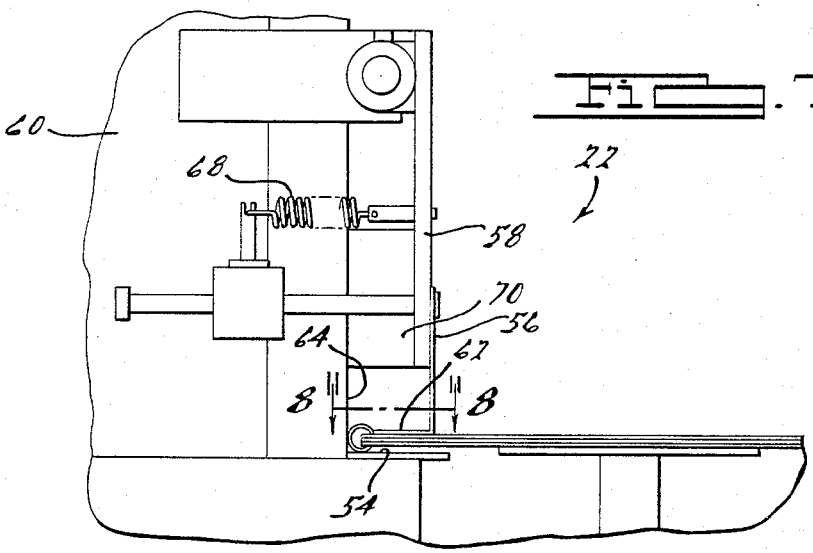
FIG. 7 is an end view of the closing station forming a part of the binder of FIG. 1.
Figure 8:
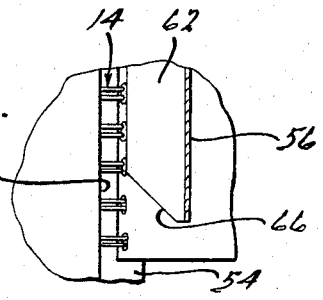
FIG. 8 is a fragmentary section view of the closing station shown in FIG. 7, the section being taken along line 8-8 thereof.
Figure 9:
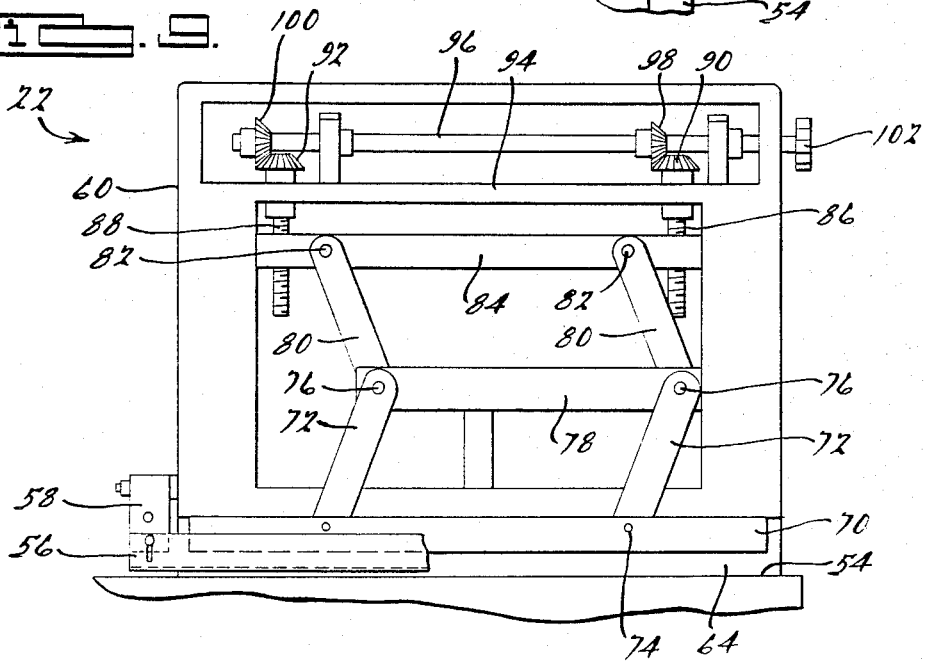
FIG. 9 is a front elevational view of the closing station of FIG. 7 with portions thereof broken away.

As best seen with reference to FIGS. 7–9, closing station 22 includes a lower support plate 54 over which the double wire binder 14 is advanced. A spring loaded guide member 56 is provided being adjustably pivotably supported in overlying relationship to support plate 54 by a pair of spaced depending arm members 58 which are pivotably secured to an adjacent upstanding support structure 60. Guide member 56 includes an inwardly projecting flange portion 62 which serves to both loosely retain the sheets against the underlying support surface 54 and more importantly to position and hold double wire binder member 14 against surface 64 forming a part of the upstanding support structure 60. As best seen with reference to FIG. 8, the leading edge 66 of flange portion 62 is beveled so as to guide double wire binder 14 into the desired position preparatory to the closing operation. Preferably the spacing between the inner edge of flange portion 62 and the opposed surface 64 will be slightly less than the width of the open double wire binder 14 such that flange member 62 will be moved outwardly slightly overcoming the biasing action of spring 68 extending between arm 58 and support structure 60 as binder 14 is moved across beveled edge 66 and into the closing station. This biasing action exerted by spring 68 will aid in measuring binder 14 is properly positioned preparatory to being closed.

In order to accomplish the closing of double wire binder 14 an elongated pressure bar member 70 is reciprocatingly supported in overlying relationship to support plate 54. Suitable guide means (not shown) will be provided to inhibit longitudinal movement of pressure bar 70 but still allow relatively free vertical reciprocation thereof. A first pair of elongated arm members 72 each have one end 74 pivotably secured to pressure bar member 70 adjacent opposite ends thereof and the other end 76 pivotably secured to an elongated actuating bar 78. A second pair of elongated arm members 80 are also provided each having one end pivotably secured to actuating bar 78 and the other end 82 pivotably secured to an overlying adjustment bar 84. Adjustment bar 84 is in turn movably supported by means of a pair of elongated threaded rods 86, 88 each of which has a bevel gear 90, 92 secured to the upper end thereof. Rods 86, 88 are rotatably axially fixedly supported by means of a cross bar 94 forming a part of the support structure 60. A drive rod 96 is also supported on and spaced from cross bar 94 and includes a pair of bevel gears 98, 100 fixedly secured thereon and positioned in driving meshing engagement with respective bevel gears 90, 92. One end of drive rod 96 projects outwardly from support structure 60 and has a suitable handle 102 provided thereon. Thus, the elevation of adjustment bar 84 may be easily and conveniently changed by merely rotating drive rod 96 via handle 102 which in turn will rotatably drive each of the threaded rods 86, 88 via respective bevel gears 90, 98 and 92, 100. As adjustment bar 84 is lowered, the extent of downward movement of the pressure bar will be increased whereas raising of adjustment bar will decrease the downward movement of the pressure bar.

In order to actuate the closing operation, a suitable cam and cam follower arrangement (not shown) is preferably utilized. However, a suitable actuating piston-cylinder assembly may be used in place thereof such as a pneumatic or hydraulically actuated piston-cylinder or alternatively an electric solenoid may be utilized. In any event, the actuating means will be connected to actuating bar 78 via suitable linkage to enable actuating bar 78 to be reciprocably moved to the left as viewed in FIG. 9, thereby effecting a downward movement of pressure bar 70 into engagement with double wire binder as a result of the longitudinal axis of bars 72 and 80 being moved into alignment whereby the open ends of the loops will be moved into a closed position such as is shown in FIG. 3. It should be noted that because the lower double wire binder contacting surface of pressure bar 70 is generally planar, it is not necessary that the binder/sheet assembly be precisely located within closing station 22. Further, the closing operation may be accomplished without regard to the existence of variations in spacing between adjacent respective loops 24 of double wire binder 14.

Once the double wire binder has been closed, a second set of pusher members 104 will operate to move the bound sheets out of the closing station 22 while simultaneously advancing the next binder and sheet assembly into position. As may be appreciated, the closing apparatus also offers great flexibility in that it may be very easily, conveniently and rapidly adjusted to accommodate a wide variety of different diameter double wire binders.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A semi-automatic binding apparatus for loosely binding together a plurality of sheets by means of an elongated continuous formed wire member having a plurality of generally C-shaped spaced loops receivable within openings provided along an edge portion of said sheets, said apparatus comprising:

means for supporting said elongated continuous wire member in such a manner as to enable said sheets to be assembled thereto, said supporting means including first and second spaced elongated members defining a channel therebetween, one end of each of said C-shaped loops being supported by the undersurface of one of said first and second elongated members, the other end of each of said C-shaped loops projecting through said channel and above the upper surface of said one elongated member whereby said sheets may be assembled thereto; and closing means longitudinally spaced from said supporting means for receiving said wire members with said sheets assembled thereto and exerting a pressure thereon operative to close said loops to thereby secure said sheets in assembled relationship.

2. A binding apparatus as set forth in claim 1 further comprising conveyor means for advancing predetermined lengths of said formed wire members into said supporting means.

3. A binding apparatus as set forth in claim 1 further comprising conveyor means for advancing predetermined lengths of said formed wire members into said supporting means and wherein said channel overlies said conveyor means.

4. A binding apparatus as set forth in claim 3 wherein said first and second plate members are removably secured to a supporting base and further comprising a spacer member interposed between one of said plate members and said supporting base.

5. A binding apparatus as set forth in claim 4 wherein the thickness of said spacer member is selected in accordance with the diameter of said spaced loops of said formed wire such that said one of said plate members may cooperate with the other of said plate members to support said formed wire in a generally upright position.

6. A binding apparatus as set forth in claim 1 wherein said closing means includes a pressure bar reciprocably movable into engagement with said loops of said formed wire.

7. A binding apparatus as set forth in claim 6 further comprising adjustment means for adjusting the distance said pressure bar is reciprocated whereby different diameter loops may be closed.

8. A binding apparatus as set forth in claim 6 wherein said pressure includes a generally planar surface movable into engagement with said loops.

9. A semi-automatic binding machine for loosely securing a plurality of sheets together by means of a double wire binder, said double wire binder comprising an elongated continuous wire member having a plurality of spaced substantially parallel loops receivable within openings provided in said sheets, said binding machine comprising:

a loading station including conveyor means operative to advance predetermined lengths of said double wire binder into said loading station and support means overlying said conveyor means, said support means being operative to support said double wire binder in an upright position with free ends of said loops projecting above said support means for receiving sheets to be bound by said double wire binder;

an idle station adjacent said loading station for receiving said double wire binder and associated assembled sheets from said loading station;

a closing station adjacent said idle station and feed means for automatically advancing said double wire binder and assembled sheets from said idle station into said closing station;

said closing station further including guide means for laterally aligning said double wire binder; and pressure bar means operative to close said loops.

10. A binding machine as set forth in claim 9 further comprising a support structure for reciprocably supporting said pressure bar means, said guide means being pivotably supported on said support structure.

11. A binding machine as set forth in claim 10 further comprising biasing means for biasing said guide means into guiding engagement with said double wire binder.

12. A binding machine as set forth in claim 9 further comprising cutting means operative to sever predetermined lengths of said double wire binder from a continuous supply.

13. A binding machine as set forth in claim 9 wherein said support means includes a spacer member, said spacer being operative to position a portion of said support means a predetermined distance above said conveyor means, said spacer being replaceable whereby said support means may be adjusted to accommodate double wire binders of different sizes.

* * * * *